United States Patent [19]

Ferrier et al.

[11] 3,961,402

[45] June 8, 1976

[54] PROCESS FOR THE PRODUCTION OF BULKED AND CRIMPED YARN

[75] Inventors: Duncan Cameron Ferrier; Thomas Berry, both of Tiverton, England; Karel Murenbeeld, Geneva, Switzerland

[73] Assignee: John Heathcoat & Company Ltd., Tiverton, England

[22] Filed: Dec. 16, 1974

[21] Appl. No.: 533,028

Related U.S. Application Data

[62] Division of Ser. No. 360,145, May 14, 1973.

[30] Foreign Application Priority Data

| | | |
|---|---|---|
| Oct. 12, 1972 | United Kingdom | 47082/72 |
| Apr. 7, 1973 | United Kingdom | 16812/73 |
| May 17, 1972 | United Kingdom | 23070/72 |

[52] U.S. Cl. ..... 28/72.14; 28/72.11

[51] Int. Cl.² ..... D02G 1/12; D02G 1/20

[58] Field of Search ..... 28/1.7, 72.14, 72.11; 219/388, 502

[56] References Cited

UNITED STATES PATENTS 3,777,338 12/1973 Vermeer et al. ..... 28/1.7

FOREIGN PATENTS OR APPLICATIONS 1,161,673 8/1969 United Kingdom ..... 28/1.7

*Primary Examiner*—Robert R. Mackey

*Attorney, Agent, or Firm*—Larson, Taylor & Hinds

[57] ABSTRACT

Bulked and crimped yarn is produced by a process comprising driving heated yarn forward to form an elongated package of compressed yarn, to which yarn is continually added at one end and withdrawn from the other end. The magnitude of the deviation of the position of the take-off end from a predetermined position is measured and used as a control parameter to control the temperature of the heated yarn.

2 Claims, 12 Drawing Figures

PROCESS FOR THE PRODUCTION OF BULKED AND CRIMPED YARNS

This is a division of application Ser. No. 360,145, filed May 14, 1973.

This invention relates to the production of bulked yarn.

Methods of and apparatus for bulking and crimping yarn are well known. It is highly desirable that the quality, mainly the bulk denier of crimped yarn, should remain as constant as possible because variation in the quality shows as variation in the texture of garments and other articles made from the bulked yarn. Variation in the quality also affects the ability of the yarn to accept dye and consequently a variation in the quality may cause variation in the shade of different parts of the same dyed article. There are two main causes of variation in the quality of the bulked and crimped yarn produced by the well known and generally used methods of bulking and crimping.

These are:

1. Differences in the quantity of thermal energy transferred or imparted to a unit mass of yarn during the bulking operation;

2. Variation in the quality of the feed yarn which causes the yarn to react differently to different amounts of thermal energy imparted to it.

With mechanical bulking and crimping devices of the stuffer box or tube type, i.e. those incorporating mechanical yarn feeding means, the rate of heat transfer is mainly dependent upon the temperature of the yarn or yarn plug heating surfaces, their cleanliness and the contact time. In a non-mechanical bulking or crimping device of the stuffer box or tube type in which the yarn is heated by a stream of hot fluid in a nozzle at a very high heat transfer rate before being compressed in the stuffer box or tube, the heat transfer rate is dependent on the fluid temperature and pressure and the average fluid turbulence pattern within the nozzle. These turbulent patterns vary from nozzle to nozzle because of slight dimensional differences between the parts of the different bulking heads of the usual multi-head device because the dimensions of the nozzles are critical and differences between nozzles within the necessary manufacturing tolerances cause differences in operating characteristics. Also the effective nozzle dimensions slowly change during operation because of deposit formation and wear caused by the passing yarn.

In considering bulking and crimping devices of the stuffer box or tube type, a distinction can be made between three-dimensionally-defined or obstructed systems, and two-dimensionally-defined or free systems. The first type occurs nearly always with fully mechanical feeding systems and the obstruction providing the third dimension in a stuffer tube is often a spring loaded flapper valve.

In an example of the second type employing a stuffer box or tube and which may be operated by fully mechanical or fluid feeding means, the stuffer box or tube is not obstructed by any mechanical means apart from wall friction and there is no third dimension in a restrictive sense and a free or floating bulked yarn plug is formed.

Other examples of such free systems are those in which bulk or crimp is produced by use of a mechanical feeding means or a nozzle which uses hot fluid to impact yarn upon a moving surface which can be made of wire mesh, or a serrated or needle-equipped surface, and where the compression plug is of the type usually referred to as a caterpillar. For convenience in this specification, the expression "elongated yarn package" or more simply "package" will be used to include both a plug and a caterpillar.

The present applicants have made the surprising discovery that the bulking quality, dependent on maintaining constancy of bulk denier, and the dyeability of bulked yarn are largely functions of the length of the elongated yarn package maintained in being in the bulking and crimping device by the addition of yarn to one end of the package and the withdrawal of yarn from the other end of the package. It has also been discovered by the present applicants that the length of the yarn package and thus the final quality and dyeability of the bulked yarn can be effectively controlled by adjusting as necessary the temperature of the yarn entering the package. In a device of the type in which the yarn feed means is a nozzle arranged to be fed with a hot operating gas, the temperature of the yarn is a function of the temperature of the gas and the heat transfer efficiency of the nozzle. As the heat transfer efficiency of the nozzle remains substantially constant over the normal operating range, the temperature of the yarn can be accurately adjusted by adjusting the temperature of the operating gas.

It was previously believed to be impossible to control the quality of the bulking in a bulking device so what control there was merely consisted in maintaining so far as could be done constant and appropriate temperature conditions in each head of the usual multi-head machine, and mechanical uniformity from head to head while allowing the machine to operate very much as it wished since it was not known which parameters were involved in determining the quality of the bulked yarn in the package produced by each head.

A regularly used method of obtaining operational control of the bulking process as opposed to quality control consists in attempting to keep the package length constant by taking off crimped yarn from the take-off end of the package at a variable speed or feeding the yarn at a variable speed, i.e. increasing the take-off speed or reducing the feed speed when the package tends to lengthen, and reducing the take-off speed or increasing the feed speed when the package tends to shorten. These widely used methods only ensure operability of the process, but they in no way take account of the reasons why the moving free package consisting of a plug in a stuffer box or tube type device or a moving caterpillar in a moving surface impact type device tends to lengthen or shorten during operation while all other process parameters apparently remain constant and they do not attempt to make compensation for changes in the length of the package. Nor do they take account of the reasons why free plugs or free caterpillars formed by different heads on the same machine or on different but apparently identical machines are generally different in length, all other conditions being apparently the same.

The methods of bulking yarn and the bulking machine previously invented by the present applicants and which incorporates an intermediate expansion chamber is extremely effective in keeping the quality of bulking within very close limits but even with this machine there is a certain amount of variation in the bulking quality between the different heads on the same multi-head machine because of the unavoidable slight dimensional differences between the corresponding parts of different heads and between replacement parts for the same head and, of course, also because of changes in the quality of the incoming yarn. Differences also result from wear and deposit formation.

The aim is thus to be able to compensate for dimensional differences and changes in yarn quality so that the bulking quality remains within such close limits that articles made from different batches of bulked and crimped yarn of nominally the same denier produced even on different machines show no distinguishable variations in any of their characteristics.

It is also an aim of the invention to provide a method of controlling the quality of bulking of yarn produced by a device incorporating a stuffer box or tube into which the yarn is driven or by a device incorporating a movable surface against which the yarn is projected.

According to the invention, a method of producing bulked and crimped yarn of substantially constant quality by the use of a bulking and crimping device of the type incorporating means arranged to receive yarn and propel it forwardly so as to form an elongated package, the yarn being added to one end of the package and being taken-off from the other end of the package in a bulked and crimped state consists in sensing the deviation of the position of the take-off end of the package from a predetermined datum position, generating a signal containing information about the magnitude of the said deviation and using said signal to control the temperature of the yarn being fed to the package.

In a technique employing a nozzle and an operating gas as the yarn feed means, the heat-exchanging means may be arranged to be capable of imparting heat to and/or extracting heat from the operating gas.

For imparting heat to the operating gas the heat-exchanging means may incorporate an electrical heating element disposed to be traversed by the gas on its way to the nozzle. The heating element is preferably arranged to operate at a safely low voltage.

Alternatively, the heat-exchanging means may be arranged to be capable of imparting heat directly to the yarn.

Where the yarn feed means are yarn feed nip rollers, the heat-exchanging means may be a heatable roller or a heatable plate or a heatable tube located in a position such that yarn on its way to the yarn feed nip rollers passes in heat-receiving relation with the roller or plate or tube which may be formed with ducts for passage of a hot fluid or may be provided with an electrical resistance heating element or an electrical induction heating coil or loop.

Where the bulking and crimping technique includes a stuffer tube, the heat-exchanging means may be a jacket surrounding at least a portion of the stuffer tube and capable of containing hot fluid, or may be an electrical resistance heating element or an induction heating coil or loop located in magnetic proximity to at least a portion of the stuffer tube.

Practical embodiments of apparatus for performing the process of the invention are illustrated in the accompanying semi-diagrammatic drawings in which:

FIG. 1 illustrates in section a bulking and crimping device previously invented by the present applicants and fitted with an apparatus according to the present invention incorporating a light emitting component and a photo-sensitive component in which the light emitting component is a light bulb and the photo-sensitive component is a photo-electric cell positioned directly opposite the light bulb and a heat-exchanging means incorporating an electrical heating element;

Figure 8:
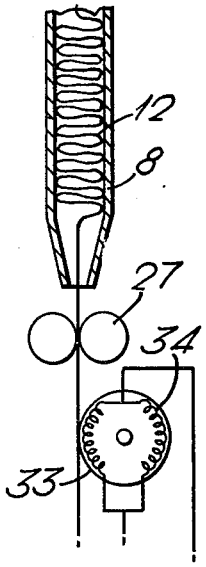
Figure 9:
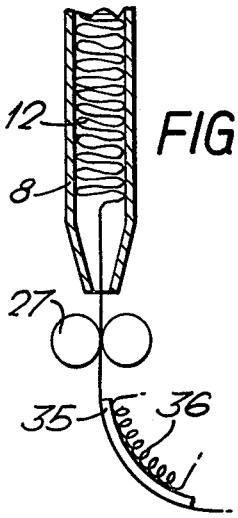
Figure 10:
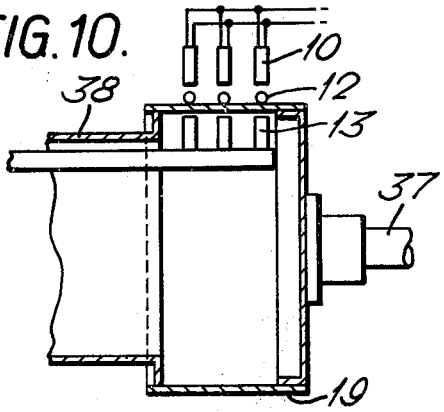
Figure 11:
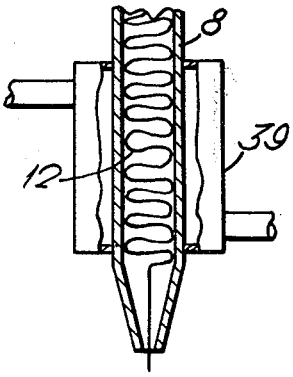
Figure 12:
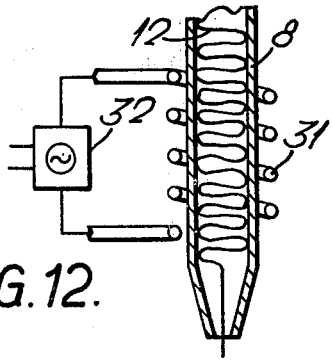

FIGS. 8 and 9 illustrate constructions having feed rollers for feeding the yarn, the construction of FIG. 8 incorporating a roller about which the yarn passes in several convolutions on its way to the feed rollers, the roller being heatable by electrical heating elements and FIG. 9 incorporates a stationary plate over the surface of which the yarn is led on its way to the feed rollers, the plate being heated by an electrical resistance heater;

FIG. 10 illustrates a portion of a bulking and crimping device incorporating a drum as a movable surface carrying several elongated yarn packages and showing the drum open to a suction duct;

FIG. 11 shows a device of the stuffer tube type fitted with a jacket surrounding a portion of the stuffer tube; and FIG. 12 shows a device of the stuffer tube type incorporating an electrical high frequency induction heating coil surrounding a portion of the stuffer tube.

Figures 1, 2, 3, 4, 5, 6:
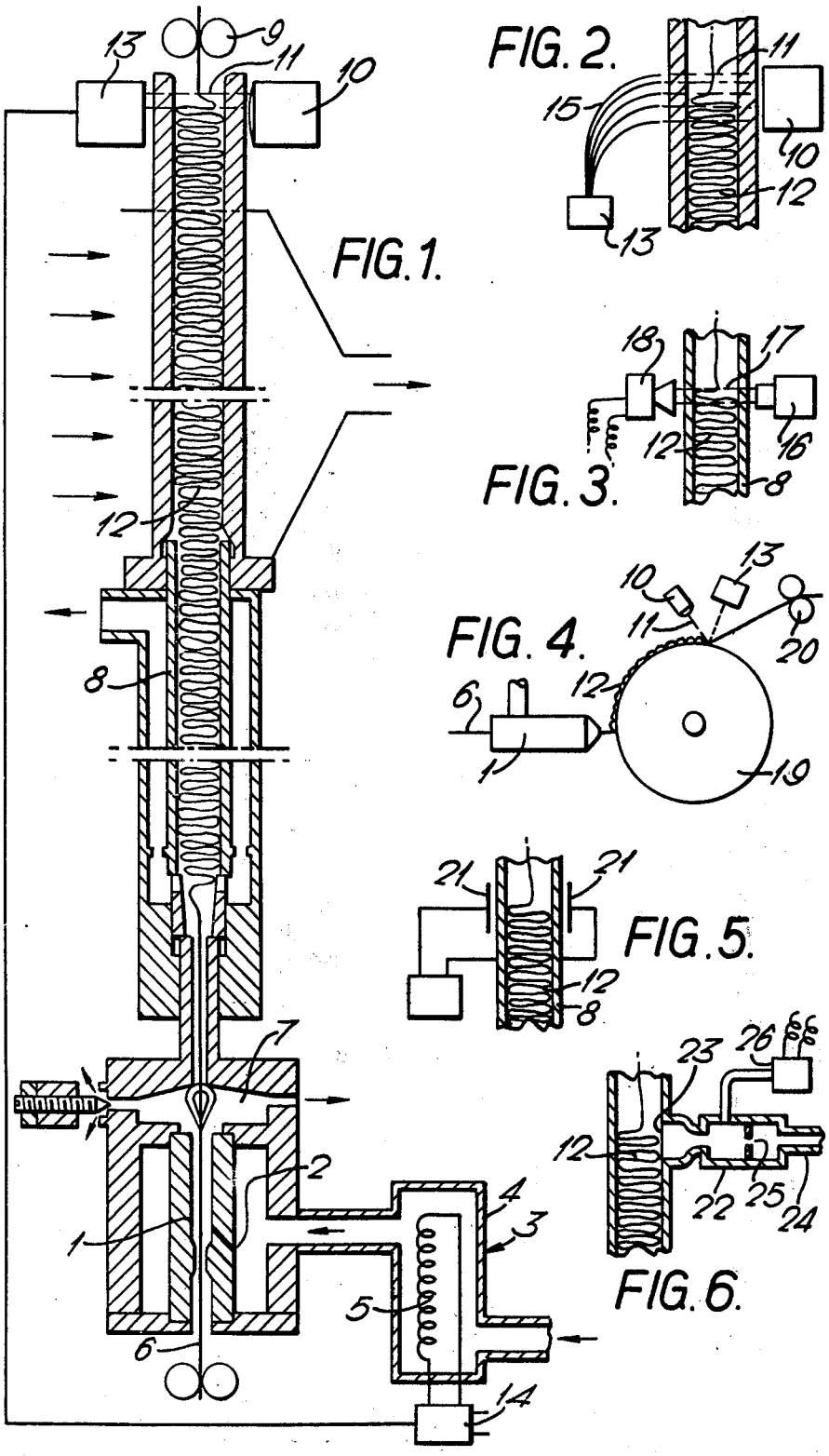
FIG. 2 illustrates a portion of the device of FIG. 1 in which the light emitting component includes light guides constituted by optical fibers.
FIG. 3 illustrates a portion of the device of FIG. 1 in which the means capable of sensing the position of the take-off end of the yarn package incorporates a sound-emitting component and a transducer component.
FIG. 4 illustrates a device of the movable surface type in which the photo-sensitive component is placed to receive light from the light emitting component by reflection from the yarn package.
FIG. 5 illustrates a portion of the device of FIG. 1 in which the means capable of sensing the position of the take-off end of the yarn package incorporates two spaced electrodes.
FIG. 6 illustrates a portion of a device of the type illustrated in FIG. 1 incorporating an electro-pneumatic device for sensing the position of the take-off end of the yarn package.

In the drawings and referring first to FIG. 1, 1 denotes a nozzle assembly arranged to receive the hot gas through the port 2, the gas traversing a heat-exchanging means 3 constituted by a chamber 4 in which there is located an electrical heat resistance element 5. The nozzle 1 is arranged to drive yarn 6 by means of the hot gas through an intermediate chamber 7 into a stuffer tube 8 in which the yarn is permanently crimped. 9 denotes take-off rollers provided to remove the bulked and crimped yarn from the stuffer tube 8. 10 denotes a light emitting component in the form of a light bulb arranged to direct a beam of light 11 across the stuffer tube 8 in the path of the yarn package 12 formed in the stuffer tube and 13 denotes a photo-sensitive component in the form of a photo-electric cell arranged to receive the beam of light 11 and generate a signal containing information about the quantity of light received from the light source 10, said signal being applied by way of an electrical control means 14 to the heating element 5. As the end of the yarn package 12 moves across the beam of light 11 as the package varies in length, the end portion of the package cuts off the beam of light or obscures it to some extent or leaves it uninterrupted according to the position of the take-off end of the yarn package 12. The signal issued by the photo-sensitive component 13 thus varies according to the position of the take-off end of the yarn package 12 and this signal influences the control means 14 to vary the quantity of current supplied to the heating element 5. The degree of heat imparted to the hot gas thus varies in conformity with the position of the take-off end of the yarn package 12. Because of the high rate of throughput of a bulking and crimping device of the type described, there is only a very small time lag between an alteration in the length of the yarn package and the necessary temperature change in the hot gas to restore the bulking quality.

Various suitable control arrangements for controlling the operation of electrical resistance element 5 of heat exchanging means 3 in response to signals from photoelectric cell 13 will be well known to those skilled in the art, and no novelty as such is claimed in any particular method of control. Exemplary control arrangements are discussed and disclosed in "RCA Transistor, Thyristor and Diode Manual", published by Radio Corporation of America in 1969, with particular reference being had to the sections on heat controls appearing at, for instance, Pages 165 and 166. Exemplary other arrangements occur in the publication "Semi-Conductor Power Circuits Handbook", published by Motorola, which includes exemplary temperature control circuits and light control circuits on Pages 6–5 through 6–22. These are exemplary only, and various other suitable arrangements will be known to those skilled in the art from the prior art.

Referring to FIG. 2 the light emitting component 10 is arranged to provide a long narrow beam 11 and the photo-sensitive component 13 is in this construction in light receiving relationship with the beam 11 by way of a set of optical fibers 15, the light input ends of which are disposed in a row and spaced logarithmically i.e. their distance apart increases exponentially from one end to the other. The light output ends of the fibers are bunched. The photo-sensitive component 13 is connected as already described to the heat exchanging means.

In the construction of FIG. 3, 16 denotes a sound emitting component arranged to emit a beam of sound waves 17 directed across the stuffer tube 8, and 18 denotes a transducer component arranged to receive the beam and issue a corresponding electrical signal which is applied as before to control operation of the heat-exchanging means.

In the construction of FIG. 4, 19 denotes a movable surface presented by a drum against which the yarn 6 is projected by a nozzle 1. The light emitting component 10 and the photo-sensitive component 13 are so disposed that the light beam 11 is reflected from the yarn package 12 in the vicinity of its take-off end when the package is a certain length. The photo-sensitive component 13 may in this set up be must usefully constituted by a television camera arranged to provide an image showing the take-off end of the package, the photo-sensitive device being arranged in light receiving proximity to the image, to be operative according to the position of the respective take-off end. The image may be arranged to appear on a remote screen or/and on a monitor screen in the camera itself. Conveniently, the photo-sensitive device is arranged at the monitor screen on the camera and the remote screen is used for remote optical monitoring.

The use of a televison camera in conjunction with a device incorporating a movable surface e.g. a rotary drum device, is particularly advantageous because usually several packages are formed side by side on the same surface and one camera fitted with a photo-sensitive device for each package can monitor all the packages simultaneously and can be placed far enough away from the device not to interfere with the mechanical parts of the device. 20 denotes guide means in the form of rollers arranged to cause the yarn to be taken off the drum 19 in a direction which is at a small acute angle to a tangent to the drum at the position of the take off end of the package 12.

Referring to FIG. 5, 21 denotes electrodes disposed at opposite sides of the stuffer tube 8. Since the yarn making up the package 12 has a different dielectric constant from air, the capacitance of the capacitor constituted by the two electrodes 21 changes according to the position of the take-off end of the package 12 between the electrodes. The electrical circuit 14 is arranged to issue a signal which varies in conformity with the change in capacitance of the capacitor and this signal is applied as before to control operation of the heat-exchanging means.

The electro-pneumatic device of FIG. 6 incorporates a nozzle 22 having a discharge end 23 formed as an elongated slot, the long dimension of which is parallel to the path followed by the package 12. The nozzle 22 is connectible by a connection 24 to a source of supply of gas under pressure and contains a restricting orifice 25. The portion of the nozzle between the restricting orifice 25 and the outlet 23 is connected to a pressure-sensitive transducer 26 which is arranged to issue a control signal in conformity with the pressure prevailing on the downstream side of the orifice 25. When the yarn package 12 becomes reduced in length a greater portion of the outlet 23 becomes exposed, more gas escapes from the nozzle and the pressure applied to the transducer 26 drops. The change in signal issued by the transducer controls operation of the heat-exchanging means as described before.

Figure 7:
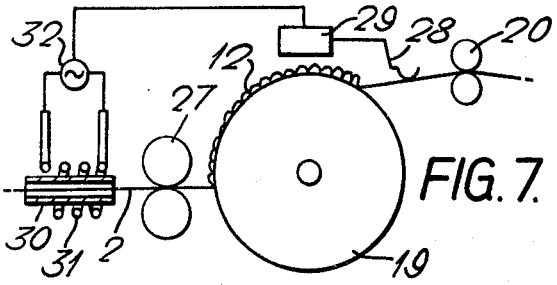
FIG. 7 illustrates a device of the type having a movable surface and rollers for feeding the yarn incorporating mechanical means for sensing the position of the take-off end of the yarn package and also a heat-exchanging tube capable of being heated by high frequency induction means for heating the yarn.

In the construction of FIG. 7, the yarn 2 is fed by feed rollers 27 and projected against the surface of the drum 19 while it is rotating and the elongated package 12 is formed on the surface of the drum 19 similar to the construction of FIG. 4. The bulked and crimped yarn drawn from the take-off end of the package 12 is guided by the guide rollers 20 to leave the package 12 at an acute angle to a tangent to the surface of the drum 19 at the take-off point of the yarn. As the length of the package 12 changes, the length of the arc on the surface of the drum covered by the package changes. As the point where the yarn is added to the package is substantially invariable in position in relation to the nozzle, the position of the take-off point changes and the angle the yarn leaving the drum makes with the tangent to the surface of the drum at the position of the yarn take off point changes. This angle is a function of the length of the package 12. A finger 28 is provided to rest on the portion of the yarn which has just left the package 12. The finger 28 is coupled to a switching device 29 associated with an electrical circuit operative to issue a signal which is in conformity with the position of the finger 28 as determined by the angle of the yarn which has left the package and thus of the length of the package 12. The signal issued is used as already described to control the operation of the associated heat-exchanging means, which in this embodiment is a tube 30 surrounded by an induction heating coil 31 electrically connected to a control circuit 32 including a high frequency generator, the yarn 2 on its way to the feeding nip rollers 27 passing through the tube 30. In the constructions of FIGS. 8 and 9, the yarn on its way to the feed nip rollers 27 passes around a drum 33 arranged to be heated by an electrical heating element 34 (FIG. 8) or over a plate 35 arranged to be heated by an electrical heating element 36 (FIG. 9). Operation of the heating element 34 or 36 is controlled in any of the ways already described.

In the device of FIG. 10, the drum 19 is mounted at one end on a stub axle 37 and carries several elongated yarn packages 12 formed simultaneously on the surface. The other end of the drum is open to a duct 38 connected to a fan or to an air extractor. Several light-emitting components 10, one for each package, are mounted outside the drum at the take-off ends of the packages 12 and several photo-sensitive components 13, one for each package, are so mounted as to be supported inside the drum opposite the corresponding light-emitting components 10. It will be understood that any of the means already described for sensing the position of the take off point of the yarn package may be substituted for the illustrated components 10 and 13.

In the construction of FIG. 11, a portion of the stuffer tube 8 is surrounded by a jacket 39 arranged for reception of a hot fluid which is arranged to pass through a heat exchanging means as already described. In the construction of FIG. 12, a portion of the stuffer tube is surrounded by an induction heating coil 31 electrically connected to a high frequency generator included in a control circuit 32, operation of which is controlled according to the length of the yarn package 12 in the stuffer tube 8 as already described.

For the purpose of cooling the yarn, a cooling element may be substituted for the heating element in the heat exchanging means in any of the described constructions.

In practice, according to the position of the take-off end of the elongated yarn package 12, a signal is sent to the heat exchanging means to alter the quantity of heat supplied to the yarn or possibly to cool the yarn, either directly or by heating or cooling the operating gas, thus controlling the length of the elongated package and consequently its quality in a bulked and crimped sense and its dyeability. In such constructions as shown in FIGS. 11 and 12, it is most advantageous to design the stuffer tubes and their heating elements in such a way that they have the lowest possible thermal inertia.

The invention also provides considerable operating advantages additional to those relating to the bulked and crimped yarn produced.

Because of the regulation provided by the construction according to the invention, many of the troubles of existing constructions are eliminated or reduced to negligible proportions. For example, one of the most intractable troubles heretofore encountered has been the gradual accumulation of foreign material in the nozzles, mostly deposits from the dressing on the thread or yarn passing through the bulking device. Such a deposit reduces the effective diameter of the nozzle resulting in an alteration in the length of the formed elongated package and a consequent change in the quality of the yarn or thread passing therethrough. Frequent cleaning of the nozzle has thus been necessary to maintain even a barely acceptable uniformity or quality of the yarn or thread. The construction of the invention maintains constant the length of the elongated package even when the nozzle has accumulated a large deposit so that much longer periods between cleaning operations become possible with improvements in the output since less production is lost in cleaning operations.

Since the device of the invention compensates automatically for considerable variation in the diameter of the nozzle, it is obviously unnecessary to manufacture the nozzles to the close tolerances heretofore required and which have been the main reason for their high cost. Much more cheaply produced nozzles thus become acceptable for use in the device. Also, again, the ability to compensate for variations in the diameter of the nozzle allows a nozzle to be used after it has become worn to a hitherto unacceptable extent. The working life of each nozzle is thus lengthened considerably.

In a device of the fluid nozzle type fitted with the apparatus of the invention, it has been found that in producing the same quality of yarn different nozzles have sometimes been operating with fluid temperatures as set by the apparatus of the invention differing by as much as 50°C. It will be appreciated then that a multi-head device of known type in which all the heads are fed with hot fluid at substantially the same temperature is certain to provide yarns or widely differing qualities from the different heads.

What is claimed is:

1. A method of producing bulked and crimped yarn of substantially constant quality by the use of a bulking and crimping device of the type incorporating means arranged to receive yarn and propel it forwardly so as to form an elongated package extending in a direction away from the receiving and propelling means, the yarn being added to one end of the package and being taken off from the other end of the package in a bulked and crimped state, comprising sensing the deviation of the position of the take-off end of the package from a predetermined datum position, generating a signal containing information about the magnitude of the said deviation and using said signal to control the temperature of the yarn being fed to the package so that the temperature of the yarn is a function of the deviation of the position of the take-off end of the yarn package from the predetermined datum position.

2. A method as claimed in claim 1 wherein said temperature control is effected by variable heat-exchanging means arranged in heat exchanging relation with the yarn and responsive to said signal.

* * * * *